United States Patent [19]

Woodward et al.

[11] Patent Number: 5,060,705

[45] Date of Patent: Oct. 29, 1991

[54] TAMBOUR DOOR AND METHOD OF MAKING

[75] Inventors: Bruce Woodward, Anchorage; James Hall, Louisville, both of Ky.

[73] Assignee: National Products, Inc., Louisville, Ky.

[21] Appl. No.: 588,751

[22] Filed: Sep. 27, 1990

Related U.S. Application Data

[60] Division of Ser. No. 393,686, Aug. 16, 1989, which is a continuation-in-part of Ser. No. 270,103, Nov. 14, 1988, abandoned.

[51] Int. Cl.[5] ..... B27D 1/00

[52] U.S. Cl. ..... 144/350; 144/345; 144/355; 156/264; 312/297

[58] Field of Search ..... 156/227, 264, 265; 312/297; D6/444, 492, 448; 144/344, 345, 350, 355

[56] References Cited

U.S. PATENT DOCUMENTS 2,751,946 6/1956 Gramelspacher ..... 144/350

3,110,533 11/1963 Bron ..... 312/297

4,731,140 3/1988 Yontrarak ..... 156/266

*Primary Examiner*—W. Donald Bray

*Attorney, Agent, or Firm*—Charles G. Lamb

[57] ABSTRACT

A tambour door includes a plurality of elongated elements having front and back surfaces of rectangular transverse cross-section placed in abutting side-by-side relationship including a flexible backing material overlaying and adhesively secured to the back surfaces of the elongated elements. The front surface of the elongated elements are formed with a design which extends over a plurality of adjacent elements. A cabinet including such tambour doors includes side pockets in which the doors move on tracks when the doors are moved to the open position. When the doors are in the closed position, they are planar and extend across the opening into the cabinet. When the door is in the closed position, the interface between adjacent elements is virtually invisible because of the abutting relationship of the elements and because of their rectangular cross-sectional shape.

13 Claims, 2 Drawing Sheets

FIG.1
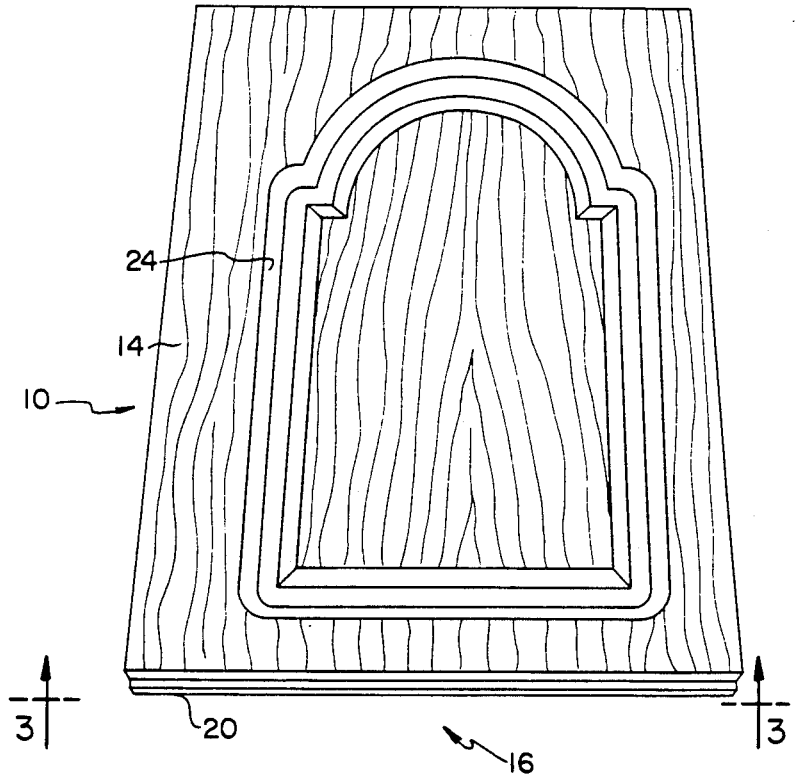
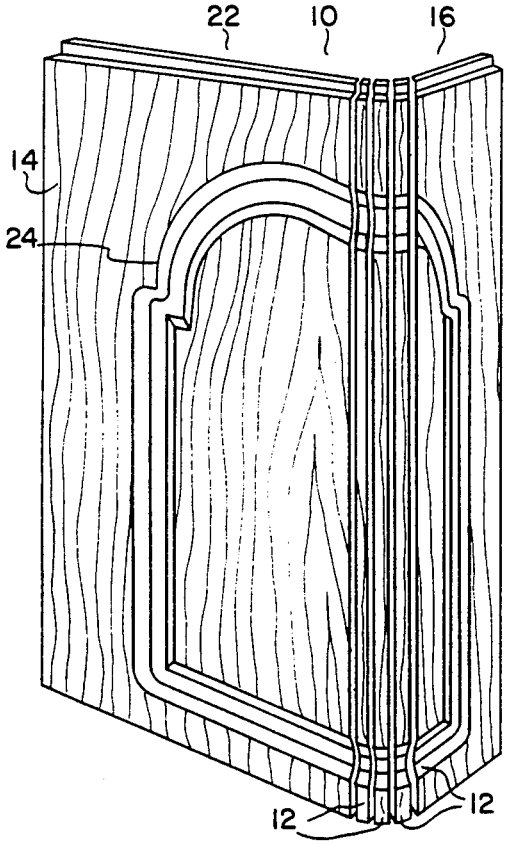
FIG.2

TAMBOUR DOOR AND METHOD OF MAKING

BACKGROUND OF THE INVENTION

This application is a divisional application of Ser. No. 393,686, filed Aug. 16, 1989 which was a continuation-in-part application of Ser. No. 270,103 filed Nov. 14, 1988, now abandoned.

The present invention relates to a tambour door wherein the door, when in use, gives a solid appearance, and more particularly may include a design which is cut into the tambour.

In the manufacture of heretofore known tambour doors, small strips of wood having tapered, chamfered, or rounded edges are placed in a touching relation and are held together by adhesively securing these pieces of wood to a flexible backing material, usually cloth. Generally, tambour doors are assembled from a random selection of wood strips cut from wood panels. And, the wood panels themselves are cut from different parts of a log. Therefore, the wood grain and color of adjacent wood strips do not match. The transversely extending grooves in these tambour doors formed by the tapered chamfered or rounded edges of the individual strips is, therefore, necessary to mask or disguise the mismatching grains and color of the wood strips. The resulting sheet which includes a plurality of transversely extending grooves thereacross, has been used for many years in roll-top desks, flexible-type closures for entertainment centers, and similar type applications.

No tambour door known to us has the appearance of a solid door because of the necessity of the grooves in the door as well as the mismatched wood grain and color.

Further, no tambour door known to us has a continuous design therein extending over a portion of the width and length of the door.

The new tambour door is designed to allow a furniture or cabinet manufacturer to design a door which incorporates the appearance of solid pocket doors or hinged doors. However, the tambour door is adaptable for movement in a curved path and in an open position is virtually out of sight.

Furthermore, prior to the present invention, the facade which included a plurality of transversely extending spaced grooves did not give the solid appearance that could be obtained with pocket or hinged doors.

SUMMARY OF THE INVENTION

The present invention provides a tambour door with a solid appearance. More particularly, the present invention provides a tambour door with a raised panel appearance. Even more particularly, the present invention provides a tambour door with an appearance and design comparative to solid doors. Furthermore, the present invention provides a tambour door with a solid appearance for a cabinet wherein the opening for the door to depth of the cabinet can be in a magnitude ratio of about three to one.

More particularly, the present invention provides a tambour door comprised of a plurality of rectangular-shaped members having face and back surfaces aligned in an abutting side-by-side relationship adhesively secured to a flexible backing material with a design on the face of the plurality of the rectangular-shaped members.

Even more particularly, the present invention provides a tambour door comprising a plurality of elongated parallel wood members, each member having a rectangular-shaped transverse cross-section, a front surface, a back surface, and sides substantially perpendicular to the front surface, the adjacent elongated members being aligned in an abutting side-by-side relationship, the elongated members having been cut from a single panel of wood and oriented in the same relationship one to the other as they were when originally cut from the wood panel such that the grain of the wood of each elongated member substantially mates with the grain of the wood of an adjacent elongated member at the interface therebetween whereby the interface between adjacent members is indistinct, and the front surfaces of the individual elongated members cooperate forming a planar overall surface providing an appearance of a solid panel; and a flexible backing material coextensive with the plurality of side-by-side elongated members adhesively attached to the rear surfaces of elongated members. Furthermore, the present invention provides a method of making a tambour door comprising the steps of placing a plurality of rectangular-shaped members having a face and a back in a side-by-side abutting relationship; attaching the members to a sheet of flexible material overlaying the backs of the members; finishing the face surfaces of the members to a smooth finish and a uniform thickness; and, forming a design in the face surface of the members.

BRIEF DESCRIPTION OF THE DRAWINGS

A better understanding of the invention will be had upon reference to the following description in conjunction with the accompanying drawings wherein like numerals refer to the parts throughout the several views and in which:

FIG. 1 is a front view of a tambour door of the present invention as it appears in the closed position;

FIG. 2 is a perspective view of the tambour door as it appears when being moved to an open position;

DETAILED DESCRIPTION OF THE PREFERRED EMBODIMENT

Figure 3:
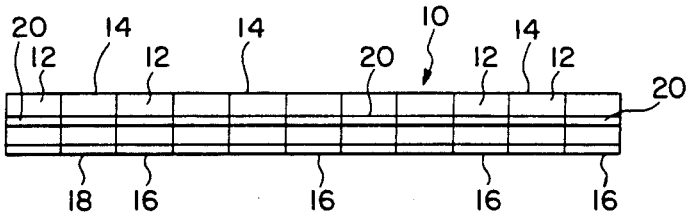
FIG. 3 is a side view of the door of FIG. 1 as seen in the direction of arrows 3—3 in FIG. 1.

With reference to FIGS. 1—3, there is shown a tambour door, generally denoted as the numeral 10, of the present invention which when in a planar configuration extends across and closes an opening to give the appearance of a solid or one-piece constructed door. Toward this objective, the tambour door 10 comprises a plurality of elongated members 12 each of rectangular transverse cross-section having a surface 14, a back surface 16 and sides. The elongated members 12 are cut from a single panel of wood and are oriented in abutting side-by-side relation in the same relationship, one to the other, as they were when originally cut from the wood panel such that the grain of wood of each elongated member substantially mates with the grain of the wood of an adjacent elongated member 12 at the interface therebetween. Therefore, the interface between adjacent members 12 is indistinct, and the front surfaces 14 of the individual members cooperate to form a planar overall door surface providing an appearance of a solid panel which has no break or interruption. Preferably, the elongated members 12 of the tambour door 10 are cut from a single panel of wood by gang ripping the panel into the members 12 so that the same saw blade cuts the adjoining or adjacent sides of the adjacent members 12. Therefore, any variations in the saw blade are mirrored in adjoining or adjacent sides of adjacent members 12 making cutting variations indistinct at the interface of said adjacent members. A sheet of flexible material 18 overlays and is adhesively secured to the back surface 16 of the elongated members 12. The backing sheet 18 holds the members 12 together in abutting side-by-side relationship when the door 10 is in the planar closed position, and allows the members 12 to pivot relative to each other about a pivot axis coinciding with the interface between adjacent members 12 as the door is moved to an open position. Therefore, the tambour door 10 has the appearance of a solid door.

The elongated members 12 can be fabricated of, for example, solid wood, hardboard, wood laminated fiberboard, and the like. The flexible sheet material 18 can be, for example, a cloth material, such as cotton, 50-50 cotton polyester blend, high strength paper and the like. The flexible sheet material 18 can be bonded to the members 12 by a suitable adhesive which will be dictated by the type of material used for the members 12 and flexible sheet 18.

The members 12 include a first or bottom flange or tenon 20 at the bottom edges of the members 12 which cooperate in end-to-end relationship to extend along the bottom edge of the door 10. The members 12 also have a second or top flange or tenon 22 at the top edges of the members 12 which cooperate in end-to-end relationship to extend along the top edge of the door 10.

The tambour door 10 advantageously includes a design 24 formed in the face surface 14 of the elongated members 12. The design 24 is a continuous design which is formed in a plurality of adjacent elongated members 12 extending across the interface of adjacent elongated members 12 such that segments of the design 24 are formed in adjacent elongated members 12 and mate at the interface of adjacent members 12. Therefore, the continuous design 24 extends across at least a portion of the width and length of the door 10. The design 24 may be routed to the door 10, or it may be carved, pressed, or the like. Furthermore, during the forming of the design, all of the rectangular-shaped members 12 are clamped or otherwise held in a non-movable situation. Thus, when the tambour door 10 is in the planar configuration, the segments of the design in the adjacent elongated members 12 have continuity forming the completed design 24 thus even further increasing the perseption that the tambour door 10 is a solid door.

Figure 4:
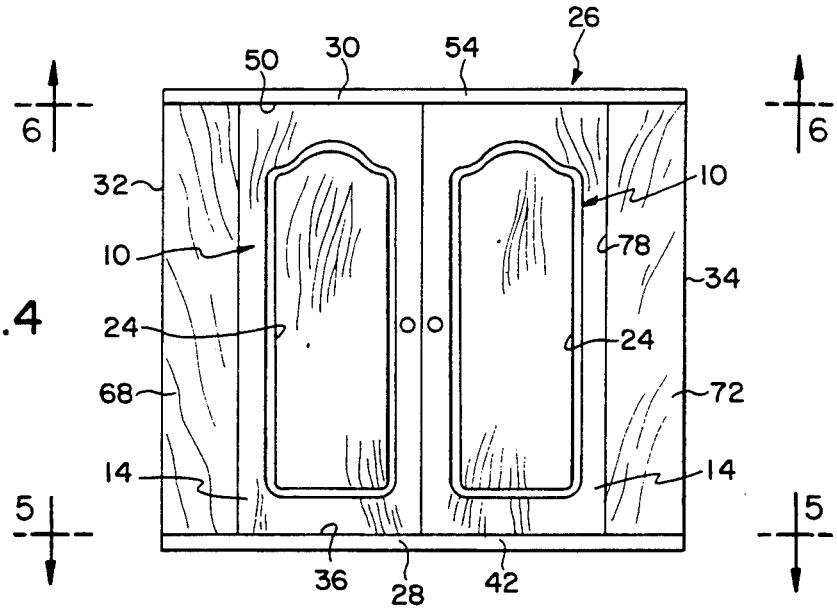
FIG. 4 is a front view of a cabinet including the tambour doors of FIG. 1.
Figure 5:
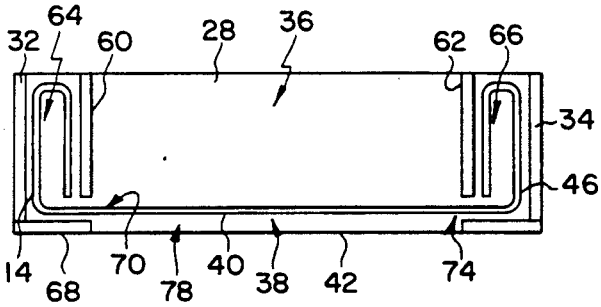
FIG. 5 is a cross-sectional view of the cabinet in FIG. 4 as seen in the direction of arrows 5—5 in FIG. 4; and, FIG. 6 is a cross-sectional view of the cabinet of FIG. 4 as seen in the direction of arrows 6—6 in FIG. 4.
Figure 6:
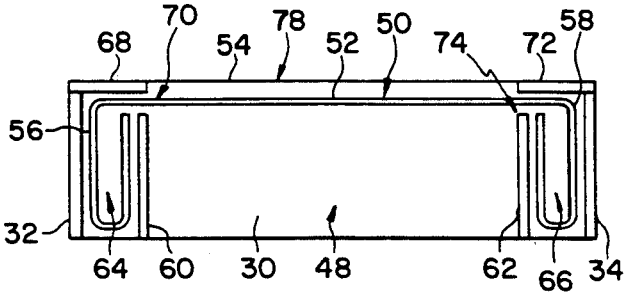

The tambour door 10 is used to open and close the front opening of, for example, a cabinet 26 as shown in FIGS. 4-6. The cabinet 26 is of the type having a bottom panel 28, a top panel 30 spaced above the bottom panel 28, and outer side panels 32 and 34 extending between the bottom panel 28 and top panel 30 closing the ends of the cabinet 26. The top or inside surface 36 of the bottom panel 28 has a bottom door track 38 of plastic enlayed in the track 38 which has a straight intermediate portion 40 extending along the length of the bottom panel 28 proximate the front edge 42 of the bottom panel 28. Track 38 is also provided with curved end sections 44 and 46 at opposite ends of the intermediate portion 40 proximate the outer side panels 32 and 34 respectively. The bottom or inside surface 48 of the top panel 30 has a top door track 50 which has a straight intermediate portion 52 extending along the length of the top panel 30 proximate the front edge 54 of the top panel 30. Track 50 is also provided with curved end sections 56 and 58 at the opposite ends of the intermediate portion 52 proximate the outer side panels 32 and 34, respectively. The bottom door track 38 is in registration with the top door track 50. The cabinet 26 also includes inner side panels 60 and 62 parallel to and spaced apart from the outer side panels 32 and 34 respectively. Panels 60 and 62 also extend between and are connected to the bottom panel 28 and the top panel 30. Thus, the outer side panel 32 cooperates with the inner side panel 60 to define a pocket 64, and the outer side panel 34 and inner side panel 62 cooperate to define a pocket 66. Each of the pockets 66 and 64 are adapted to receive a tambour door 10 therein. The front edge of the inner side panel 60 adjacent to the outer side panel 32 terminates a short distance behind the front edge of the outer side panel 32, and the inner panel 62 adjacent the outer panel 34 terminates a short distance behind the front edge of the outer side panel 34. The curved end section 44 of the bottom door track 38 and the curved end section 56 of the top door track 50 are located in the pocket 64 between the adjacent outer side panel 32 and inner side panel 60, and the curved end section 46 of the bottom door track 38 and the curved end section 58 of the top door track 50 are located in the pocket 66 between the adjacent outer side panel 34 and inner side panel 62. A short front panel 68 is located across the front of the pocket 64 and cooperates with the front edge of the inner side panel 60 to define a door slit 70 therebetween open to the pocket 64. A short front panel 72 is located across the front of the pocket 66 and cooperates with the front edge of the inner side panel 62 to define a door slit 74 therebetween open to the pocket 66.

The tambour door 10 is positioned in the cabinet 26 with the bottom flange 20 received in the bottom door track 38 and the top flange 22 received in the top door track 50 which also includes a plastic inlay therein. This enables the door 10 to move in the bottom and top door tracks 38 and 50 between a closed planar position in which the door 10 extends across the cabinet opening 78, and an open position away from the cabinet opening 78 thereby providing access to the interior of the cabinet 26. As shown, the cabinet 26 has two identical tambour doors 10 which when closed are coplanar, extend along the straight intermediate portions 40 and 52 of the bottom and top door tracks 38 and 50, and interface at the centerline of the cabinet opening 78. To open the cabinet 26, the two doors 20 are moved in opposite directions to each other in the bottom and top door tracks 38 and 50 through the door slits 70 and 74 to the open position so that each door 10 is moved away from the cabinet opening 78 occupying the pockets 64 and 66, respectively. Toward this objective, the curved end sections 44, 46 of the bottom track 38 and the curved end sections 56, 58 of the top track 50 each have an overall length at least equal to the width of a door 10 so that when in the open position the doors 10 are each totally enclosed in the appropriate pocket 64, 66 and hidden from view.

With further reference to FIGS. 5 and 6, the curved end sections 44, 46 of the bottom track 38 and the curved end sections 56, 58 of the top track 50 can follow virtually any convenient path. As shown, the curved end sections 44, 46, 56 and 58 follow a loop path into the pockets 64, 66 respectively, with the end of the track adjacent the straight portion of the track near the slit 70, 74. Thus, when the doors 10 are in their open position, they are each doubled back over themselves conforming to the looped shape of the curved track end sections which allow for a cabinet 76 to be of small depth or front to back dimention. In the exemplified cabinet in FIGS. 4–6, the opening for the door to depth of the cabinet is in a ratio of about three to one.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A method of making a tambour door comprising the steps of:

placing a plurality of members of rectangular-shaped cross-section having a face and a back surface in a side-by-side abutting relationship;

attaching the members to a sheet of flexible material overlaying the back surface of the members;

finishing the face surface of members to a smooth finish and to a uniform thickness; and, forming a design in the face surface of the members.

2. A method of making a tambour door comprising the steps of:

cutting a plurality of elongated parallel members from a single panel of wood, each elongated member having a rectangular shaped transverse cross-section with a front surface, back surface, and sides substantially perpendicular to the front surface;

positioning the individual elongated members in aligned abutting side-by-side relationship in the same relationship one to the other as they were when originally cut from the wood panel such that the grain of the wood of each elongated member substantially mates with the grain of wood of an adjacent elongated member at the interface therebetween whereby the interface between adjacent elongated members is indistinct, and the front surfaces of the individual elongated members cooperating to form a planar overall surface providing an appearance of a solid panel; and, attaching the elongated members to a sheet of flexible material overlaying the back surfaces of the elongated members.

3. The method of claim 2, comprising the further step of finishing the front surface of the elongated members to a smooth finish.

4. The method of claim 3, wherein the step of finishing the face surface of the members comprises sanding the face surfaces of the members.

5. The method of claim 3, wherein the step of finishing the face surface of the members comprising planing the face surfaces of the members.

6. The method of claim 2, comprising the further step of forming a design in the face surface of the members.

7. The method of claim 6 wherein the step forming the design in the face of the members comprises carving the design therein.

8. The method of claim 6, wherein the step forming the design in the face surface of the members comprises pressing the design therein.

9. The method of claim 6, wherein the step forming the design in the face surface of the members comprises routing the design therein.

10. The method of claim 6, wherein the step of forming includes the step of holding all of the rectangular-shaped members in a non-movable position as the design in the face surface is being made.

11. The method of claim 2, comprising the further step of forming a design in the front surface of the elongated members.

12. The method of claim 2, comprising the further step of forming the design extending across the interface between adjacent elongated members.

13. The method of claim 2, comprising the further step of forming a continuous design in a plurality of adjacent elongated members extending across the interface of adjacent elongated members such that segments of the design in adjacent elongated members mate at the interface and the design segments cooperate to form the continuous design extending across at least a portion of the width and length of the door.

* * * * *